US006503050B2

(12) United States Patent
Reimer et al.

(10) Patent No.: US 6,503,050 B2
(45) Date of Patent: Jan. 7, 2003

(54) TURBO-MOLECULAR PUMP HAVING ENHANCED PUMPING CAPACITY

(75) Inventors: Peter Reimer, Los Altos, CA (US); Dennis R. Smith, San Jose, CA (US); Jay Patel, Fremont, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 09/739,138

(22) Filed: Dec. 18, 2000

(65) Prior Publication Data

US 2002/0076317 A1 Jun. 20, 2002

(51) Int. Cl.[7] ..... F01D 1/00
(52) U.S. Cl. ..... 415/90; 416/201 A
(58) Field of Search ..... 415/90; 416/175, 416/198 R, 201 R, 201 A, 203

(56) References Cited

U.S. PATENT DOCUMENTS 4,111,595 A * 9/1978 Becker et al. ..... 415/90
RE33,129 E * 12/1989 Mase et al. ..... 415/90
4,978,276 A * 12/1990 Kabelitz et al. ..... 415/55.3
5,386,166 A * 1/1995 Reimer et al. ..... 310/90.5
5,577,883 A * 11/1996 Schutz et al. ..... 415/90
5,729,065 A * 3/1998 Fremery et al. ..... 310/90.5
6,106,223 A * 8/2000 Leyshon ..... 415/90
6,343,910 B1 * 2/2002 Kawasaki et al. ..... 415/90 X
6,409,468 B1 * 6/2002 Kawasaki ..... 415/90 X
6,422,829 B1 * 7/2002 Schutz ..... 415/90

* cited by examiner

*Primary Examiner*—John E. Ryznic
(74) *Attorney, Agent, or Firm*—Moser Patterson & Sheridan; Joseph Bach

(57) ABSTRACT

In one aspect, a vacuum processing system comprising a vacuum processing chamber and a turbo-molecular pump disposed on the vacuum processing chamber is provided. The turbo-molecular pump comprises a casing having an inlet port and an outlet port, a stator disposed on an inner wall of the casing, a rotor disposed in the stator, and a motor extending coaxially with the rotor, wherein at least the first stage of the pump is enlarged with no correspondingly larger pump components other than the corresponding upper portion of the housing.

11 Claims, 6 Drawing Sheets

TURBO-MOLECULAR PUMP HAVING ENHANCED PUMPING CAPACITY

BACKGROUND OF THE INVENTION

1. Field of the Invention

The present invention generally relates to semiconductor processing. Specifically, the present invention relates to semiconductor processing equipment and a turbo-molecular vacuum pump with increased pumping capacity for evacuating a vacuum processing chamber.

2. Background of the Related Art

Substrates are typically processed through various etch, chemical vapor deposition (CVD), physical vapor deposition (PVD), ion implanting and cleaning steps to construct integrated circuits or other structures thereon. These steps are usually performed in an environmentally isolated and vacuum sealed substrate processing chamber. The substrate processing chamber generally comprises an enclosure having a side wall, a bottom and a lid. A substrate support member is disposed within the chamber to secure a substrate in place during processing by electrical or mechanical means such as an electrostatic chuck or a vacuum chuck. A slit valve is disposed on a chamber side wall to allow the transfer of the substrate into and out of the substrate processing chamber. In CVD processes, various process gases enter into the substrate processing chamber through a gas inlet, such as a shower-head type gas inlet, disposed through the lid of the processing chamber. In PVD processes, various process gases enter into the substrate processing chamber through a gas inlet in the processing chamber. In each type of process, the gases are exhausted from the substrate processing chamber through the use of a vacuum pump, such as a turbomolecular pump, which is attached to a gas outlet of the substrate processing chamber.

Turbo molecular pumps are used in high ($10^{-7}$ Torr) or ultra-high ($10^{-10}$ Torr) vacuum systems, exhausting to a backing pump that establishes a first pressure in the chamber. The turbo molecular pumps include a rotor with rows of oblique radial blades turning between a stator having inwardly facing rows of blades. The outer tips of the rotor blades approach molecular speed of the gas being pumped and when a molecule strikes the rotor, a significant component of momentum is transferred to the molecule in the direction of rotation. This transferred momentum causes the molecule of gas to move from the inlet side of the pump towards the exhaust side of the pump. Turbo molecular pumps are characterized by a rotational speed of 20,000 to 90,000 rpm and a pumping speed or capacity of 50 liters/sec. to 5,000 liters/sec.

FIG. 1 is a cross-sectional view of a typical turbo-molecular pump 10. The turbo-molecular pump 10 generally comprises a cylindrical casing 72, a base 74 closing the bottom of the casing 72, a rotor 40 disposed coaxially in the casing 72, a motor 20 coaxially disposed with the rotor 40, and a stator 30 extending radially inwardly from the casing 72. The casing 72 provides a support structure for the turbo-molecular pump 10 and includes an inlet port 12 disposed through the top of the casing 72. An outlet port 14 is disposed through the base 74 and is attached to a backing pump and an abatement system (not shown) for recovery or disposal of the gases. The motor 20 is an electrical motor that rotates the rotor 40 about an axis. The rotor 40 may be suspended by mechanical bearings 37 or by magnetic bearings in a floating condition with the casing.

Rotor blades 46 and stator blades 36 are shaped to pump gas from the inlet port 12 to the outlet port 14 and to prevent gas flow back into the vacuum processing chamber (not shown). The rotor 40 includes rows of rotor blades 46 extending radially outwardly in levels from a central cylindrical portion of the rotor that receives a portion of the motor 20. The stator 30, likewise includes rows of blades 36 extending radially inwardly in levels from the casing 72. The rows of stator blades 36 are arranged at alternating axial levels with the rows of rotor blades 46, and a plurality of spacer rings 38 separate different levels of stator blades 36 to ensure that the rotor blades 46 can rotate freely between stator blades 36. A "first stage" of the pump is defined by the first row of rotor blades 46 and the first row of stator blades 36 at the intake end of the pump. Each row of rotor blades 46 and corresponding row of stator blades 36 thereafter make up another stage and there are typically between 5 and 13 stages in a turbo-molecular pump. Additionally, a compound stage including a cylindrical member (not shown) extending from the exhaust end of the rotor 40 may be included to achieve a higher exhaust pressure and a higher inlet pressure.

Because of exacting temperature and cleanliness considerations in substrate processing, the substrate processing vacuum chambers are housed in an isolated clean room. Because the turbo molecular pumps must reduce pressure in the chambers down to $10^{-7}$ Torr, they are necessarily located in the clean room adjacent the chambers to avoid any loss in pumping efficiency that would occur if the pumps were separated from the chambers by vacuum lines. Because the cost of building and maintaining clean rooms is so expensive, the physical size of components therein, including the turbo molecular pumps is always critical.

FIG. 2 is a simplified schematic, cross-sectional view of a vacuum substrate processing chamber 100 having a turbo-molecular pump 10 attached thereto. The turbo molecular pump 10 may be directly under the substrate 160 or offset, as depicted in FIG. 2. The chamber 100 and pump 10 make up part of a processing apparatus typically comprising several processing chambers and at least one transfer chamber. The substrate processing chamber 100 provides an isolated environment where the substrate 160 is processed through etching, deposition, implanting, cleaning, cooling and/or other pre-processing and post-processing steps. The substrate processing chamber 100 generally comprises an enclosure having side walls 104, a bottom 106 and a lid 108. A substrate support member 110 disposed in the bottom 106 of the chamber secures the substrate 160 in place during processing. The substrate support member 110 typically comprises a vacuum chuck or an electrostatic chuck to retain the substrate 160. A slit valve 112 is disposed on the chamber side wall 104 to allow the transfer of the substrate 160 into and out of the substrate processing chamber 100. In a CVD process, various process gases enter into the substrate processing chamber 100 through a gas inlet 120, such as a shower-head type gas inlet or nozzle, disposed through the lid 108 of the processing chamber. To exhaust the gases from the substrate processing chamber, a turbo-molecular pump 10 is attached to a gas outlet 130 of the substrate processing chamber 100.

Advances in substrate processing and increased capacity of vacuum processing chambers continuously call for higher capacity pumps. Some substrate processes like plasma-based etch and CVD processes require particularly high process gas flow rates and relatively shallow vacuum levels. As the flow rate of the reactants across the substrate processing surface is increased (i.e., the throughput of the vacuum pump increases to exhaust a higher volume), the time required for completion of the process is reduced. Thus, to increase throughput of the processing chamber, the vacuum pumping system used for plasma-based etch and CVD requires a high throughput or exhaust capacity. Furthermore, as the chamber sizes increase to accommodate larger substrates (i.e., 300 mm substrates), the turbo-molecular pumps used for these larger chambers must provide correspondingly larger exhaust capacities. For example, an exhaust capacity of 4000 l/sec. is required for a 300 mm chamber.

One way to decrease exhaust time and increase throughput of the pump is to increase the rotational speed of the rotor of the turbo-molecular pump. However, increasing the rotational speed of a rotor and the rotor blades necessarily results in additional stresses on the rotor and other components that can lead to failure of the pump components. Additionally, because of the high throughput of the process gases through the vacuum pump, unused reactants as well as reaction byproducts are removed from the processing chamber at a high rate and can either adhere to or react with the surfaces of the components inside the vacuum pump, causing the components to heat up significantly and resulting in breakdown of the component and the pump. For example, in HDP applications the pump internal components, such as a rotor, can rise to a temperature above 120° C., and the stress caused by the high temperature can cause a physical break down of the component and the pump. Therefore, simply increasing the rotational speed of the pump is not a realistic solution.

Another way to increase the throughput or exhaust capacity of the vacuum pump and to decrease the time it takes to exhaust gases from a processing chamber is to increase the physical size of the turbo-molecular pump. For example, adding surface area to the blades of the rotor and stator by increasing their length will increase the flow of gas through the pump. However, because of the radial stresses brought to bear by the larger blades upon the rotor, the rotor must also be enlarged and strengthened to tolerate the larger blades. Likewise, the rotor bearings must be larger and more robust to compensate for the added vibration of the pump and there must be a corresponding increase in the size of the pump housing. The result is a pump with increased overall dimensions and weight. The larger pumps are more expensive to build, use additional energy to operate and cause more vibration in the clean room. Further, the larger pumps take up more of the precious envelope and clean room space below the vacuum chamber, giving the apparatus a larger footprint.

Therefore, there is a need for a turbo-molecular vacuum pump that provides a higher exhaust capacity than existing turbo-molecular pumps without a corresponding increase in the physical size and weight of the pump. There is a further need for a turbo molecular pump with enlarged capacity that requires a reduced amount of clean room space. There is a further need for a turbo molecular pump that creates less vibration than other pumps having the same capacity.

SUMMARY OF THE INVENTION

In one aspect, a vacuum processing system comprising a vacuum processing chamber and a turbo-molecular pump disposed on the vacuum processing chamber is provided. The turbo-molecular pump comprises a casing having an inlet port and an outlet port, a stator disposed on an inner wall of the casing, a rotor disposed in the stator, and a motor extending coaxially with the rotor, wherein at least the first stage of the pump is enlarged with no correspondingly larger pump components other than the corresponding upper portion of the housing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefor not to be considered limiting of its scope, for the invention may admit to other equally effective embodiments.

DETAILED DESCRIPTION OF A PREFERRED EMBODIMENT

Figure 1:
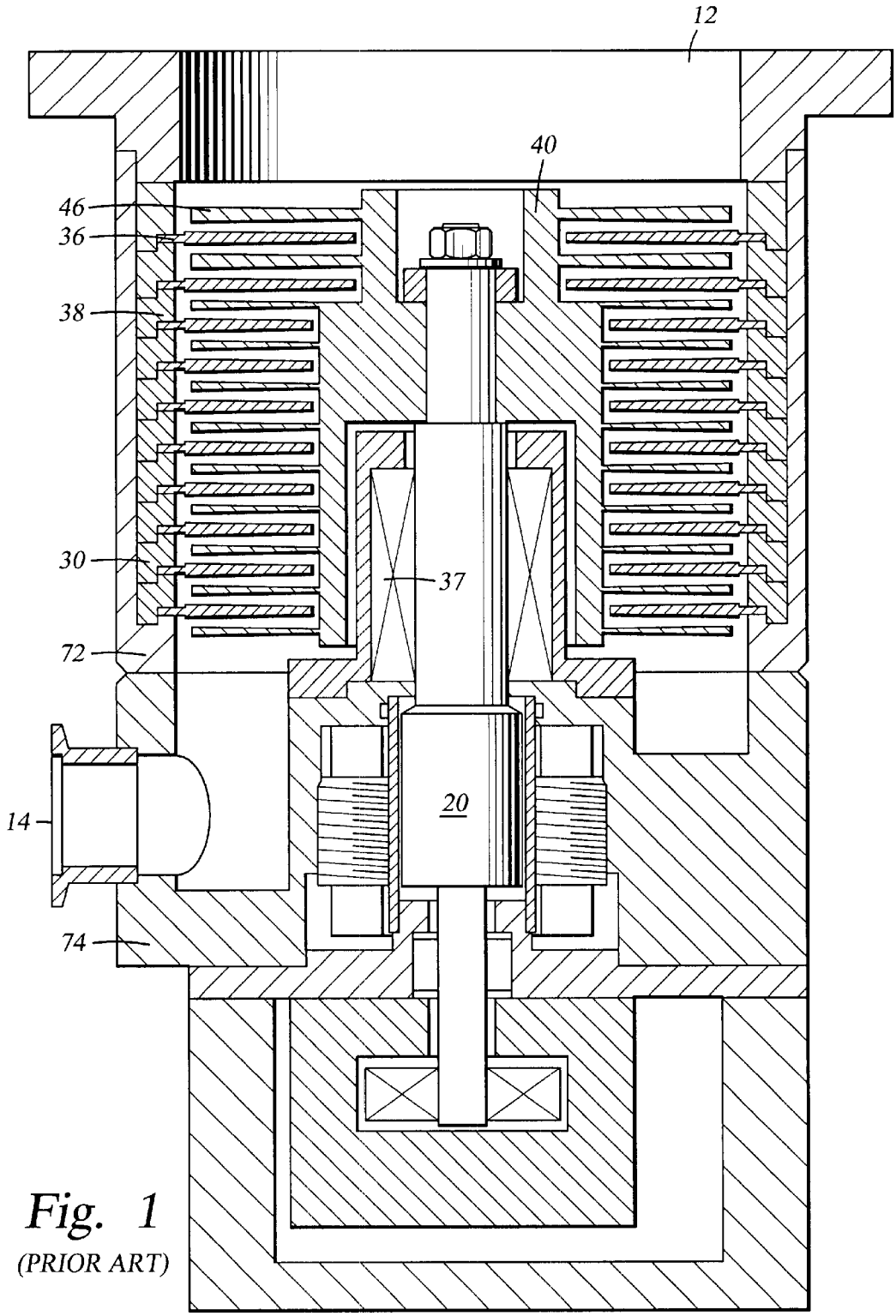
Fig. 1 (PRIOR ART)
FIG. 1 is a cross-sectional view of a prior art, turbo molecular pump.
Figure 2:
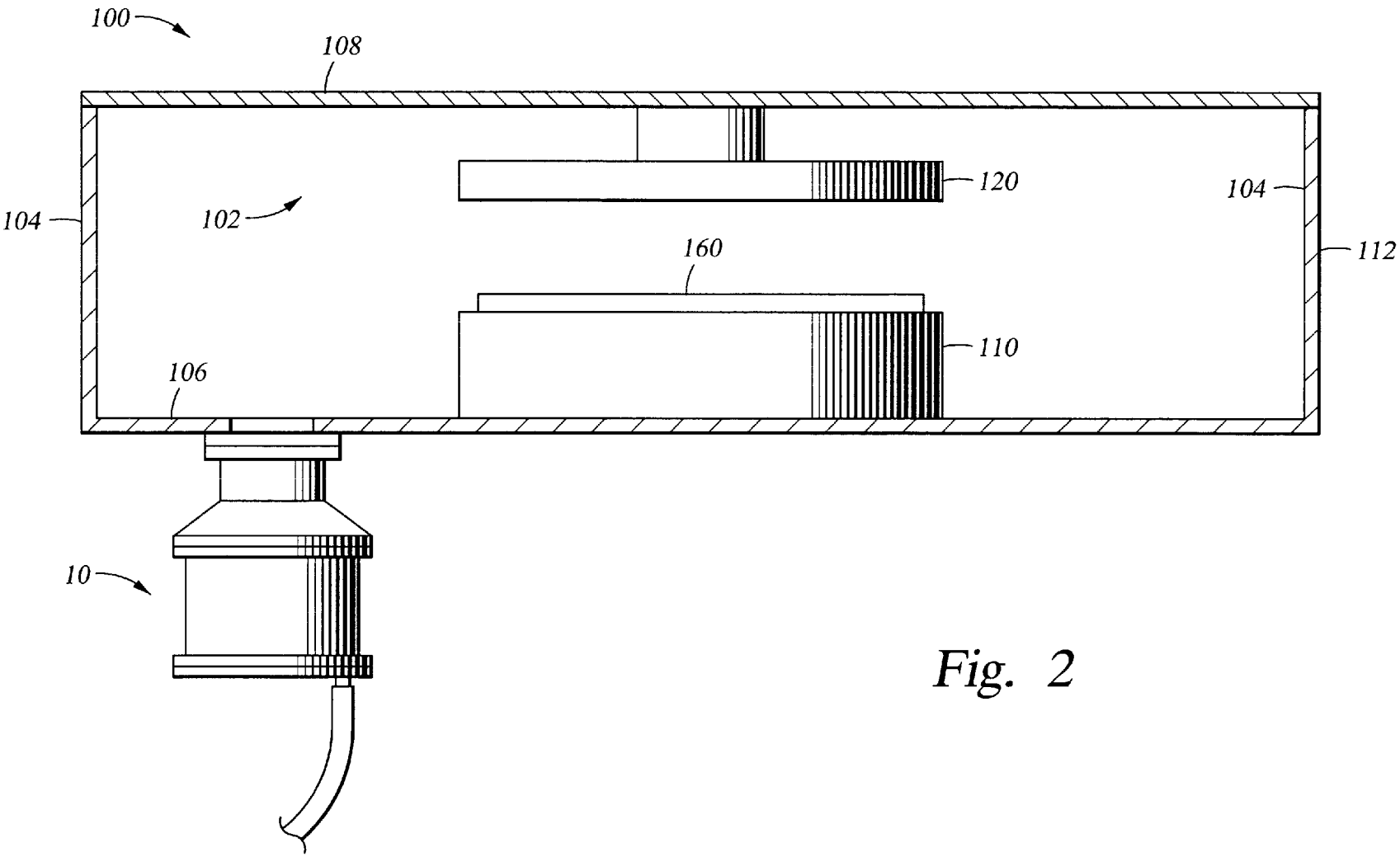
FIG. 2 is a simplified schematic cross-sectional view of a vacuum substrate processing chamber 100 having a turbo-molecular pump 10 attached thereto.
Figure 3:
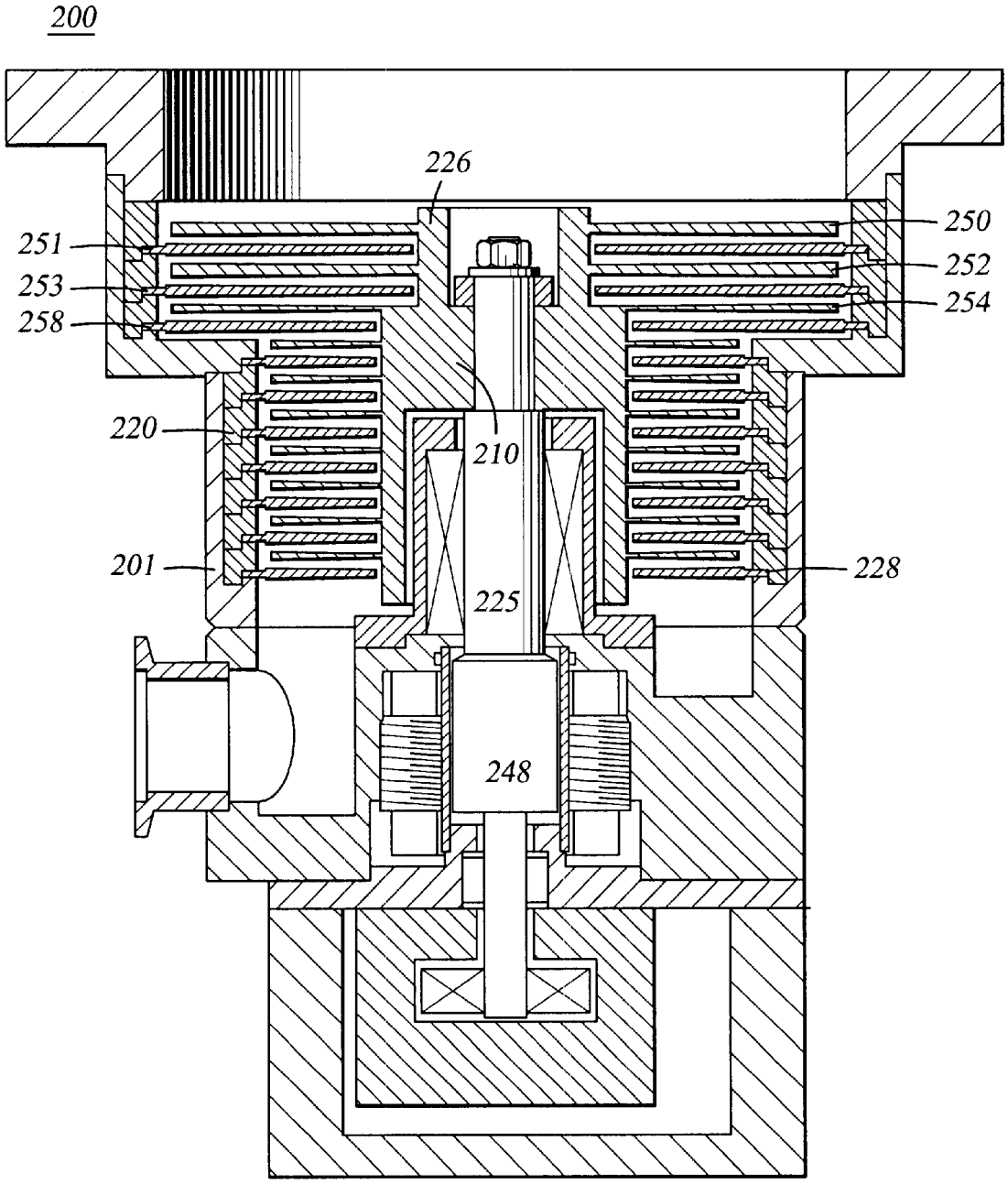
FIG. 3 is a cross-sectional view of a turbo-molecular pump 10 of the invention having the first three pump stages enlarged.

FIG. 3 is a cross-sectional view showing one embodiment of the pump 200 of the present invention. The pump includes a stator 220 extending radially inwardly from the casing 201 and a rotor 210 disposed within the casing. A motor 248 is coaxially disposed with the rotor and rotates the rotor 210 about a shaft 225. The rotor 210 includes two outer diameters, a smaller diameter 226 adjacent an inlet 205 of the pump and a lower, larger diameter 228 extending towards an outlet 206 of the pump. In the embodiment illustrated in FIG. 3, the first two rows of rotor blades 250, or those blades extending from the smaller diameter portion 226 of the rotor 210, have an increased length as compared to the other rotor blades 225 extending from the larger diameter 228 of the rotor 225. The corresponding stator blades 251 are also increased in length extending inwards from an enlarged diameter portion 253 of the stator 220. The longer stator and rotor blades 250, 251 provide an increased surface area and a corresponding increase in pumping capacity. Because of their increased length, the tips of the rotor blades 250 move at a speed exceeding the speed of sound of a pumped process gas (about 300m/s for nitrogen). This results in enhanced compression of gas in the first stages and an overall increase in the pumping speed or exhaust capacity of the pump 200.

Because the longer rotor blades 250 extend from the smaller diameter portion 226 of the rotor 210, a relatively small increase in the diameter of the casing 201 is necessary. Also, because the enlarged portion of the casing 201 is limited to the upper portion or that portion typically attached to a vacuum chamber, the increase in size is less likely to interfere with other equipment or personnel working in the clean room. Further, the increased stress on the rotor brought about by the longer blades with their higher tip speed is minimized since the rotor diameter is smaller at the point where the longer blades 250 are attached and radial forces are not nearly so high as they are along the larger diameter portion 228 of the shaft 225.

Figure 4:
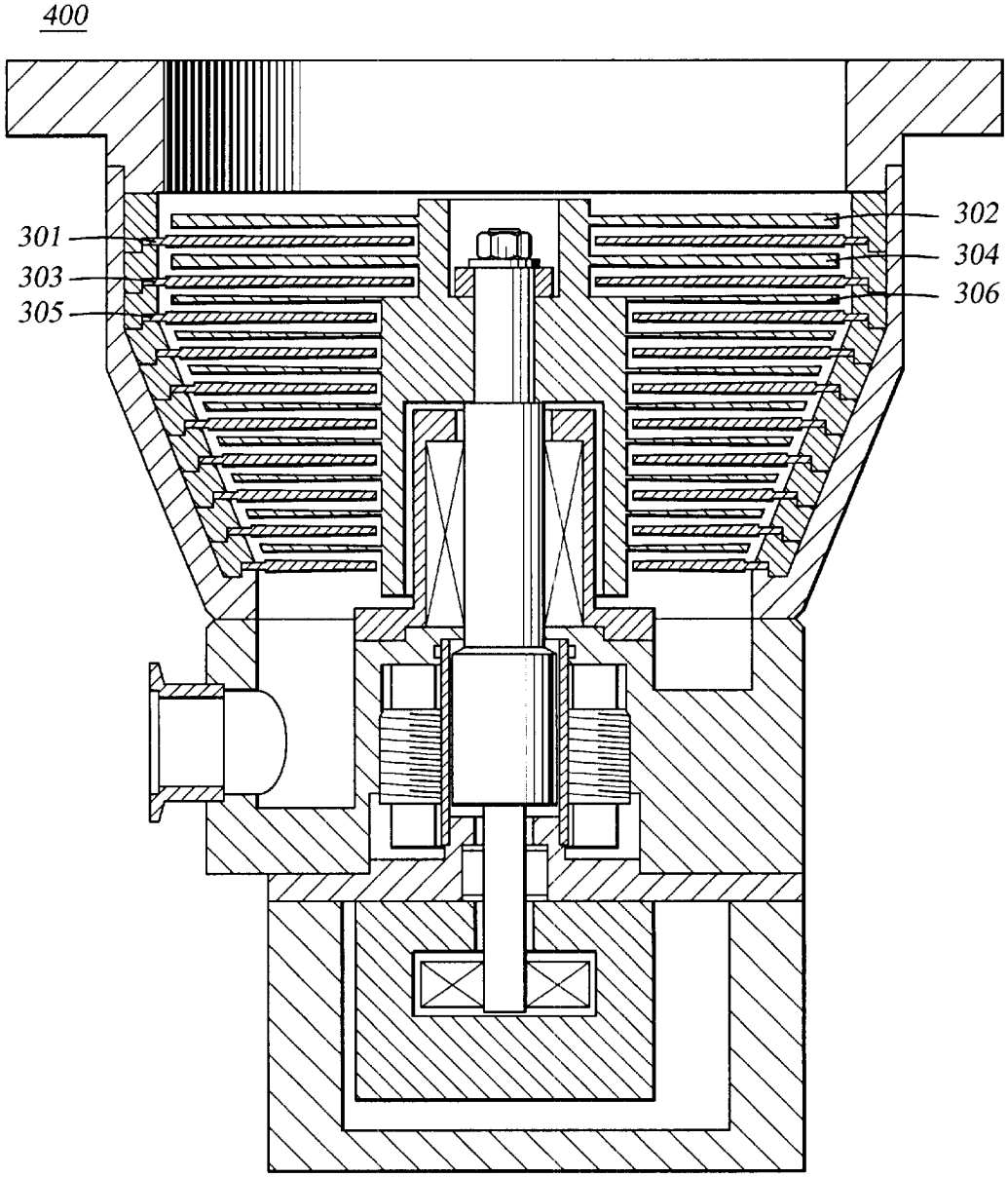
FIG. 4 is a cross-sectional view of another embodiment of the turbo-molecular pump 10 of the invention showing the first three stages enlarged and thereafter, tapered stages.

FIG. 4 is a section view showing an alternative embodiment of a pump 400 of the invention. The pump includes a rotor 310 having a smaller diameter 326 portion adjacent a pump inlet 305 and a larger diameter portion 328 extending toward a pump outlet 306. A stator 320 includes blades of different lengths extending inwards from a casing 301. Like the embodiment of FIG. 3, the first two rows of rotor blades 302 and the first two rows of stator blades 301 and an inlet 305 at the intake end of the pump 400 are increased in length as compared to the subsequent rotor and stator blades. Thereafter, the rotor blades extending towards a pump outlet 306 gradually decrease in length. For example, in one embodiment, each subsequent rotor blade is about 10–15% shorter than the preceding blade. The casing 305 likewise is tapered to house the longer blades but no other modifications are necessary to compensate for the increased capacity brought about by the increased surface area of the longer blades. The result of the tapered blades is a greater increase in overall blade surface area and a greater increase in pumping capacity.

Figure 5:
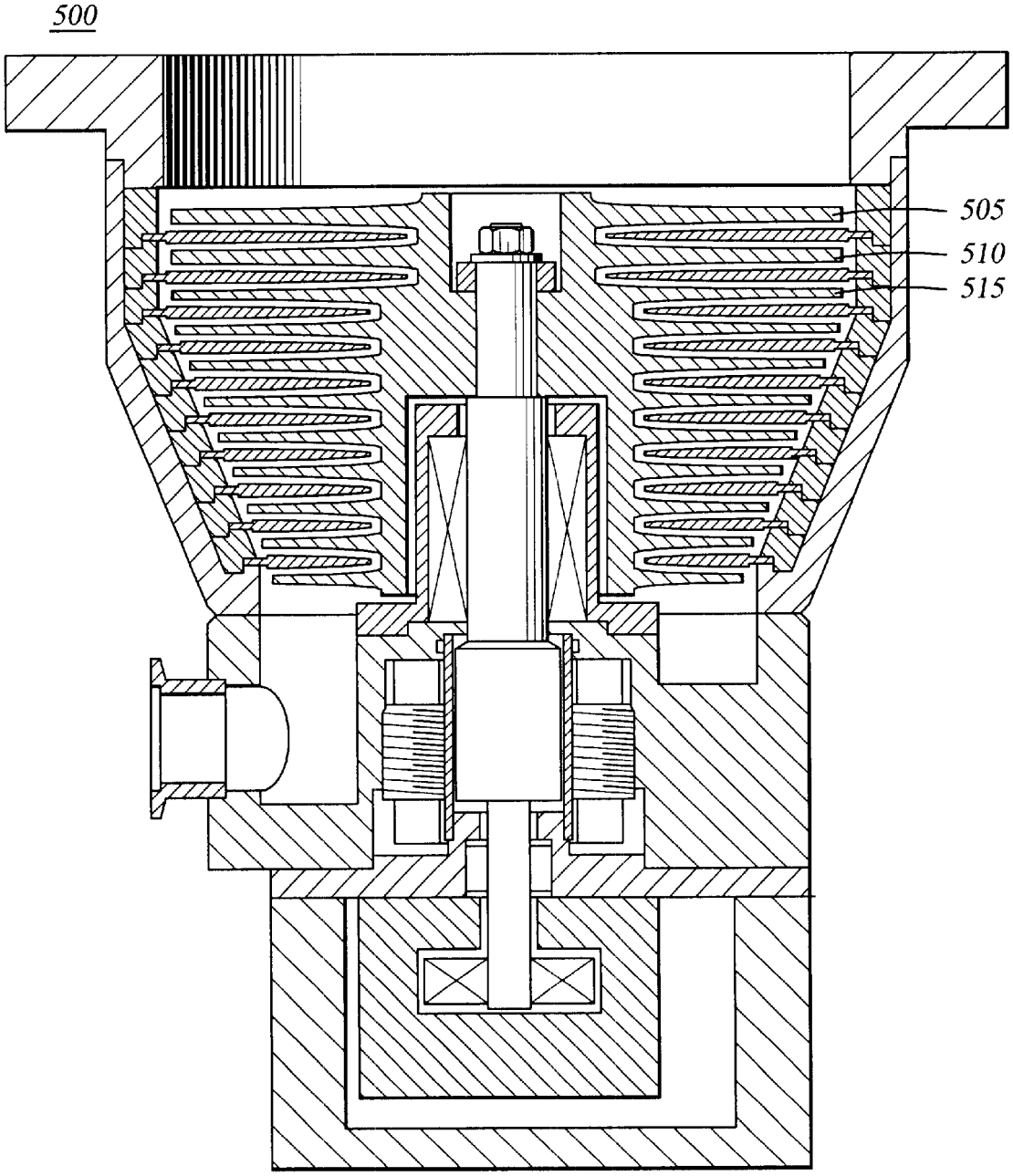
FIGS. 5 is a section view showing tapered blades wherein the rotor blades are strengthened at their base.

While the embodiments of the present invention increase pumping capacity with no enlargement of the rotor itself, the lengthened rotor blades can benefit by a high strength connection to the rotor to compensate for the higher tip speed of the blades. FIG. 5 is a section view of a pump 500 having similar components of pump 400 of FIG. 4. In the pump 500 of FIG. 5, the base of each rotor blade 505 is modified to add additional strength to the rotor blades at their point of attachment to the rotor. Specifically, the base 520 of each rotor blade is widened by adding additional material which serves to increase the strength of the blade at its point of attachment to the rotor 510. The increase in blade material at the base of the blade results in a corresponding increase in strength and stress resistance of the blade. In this manner, the blade design compensates for any additional stress brought about by the increased length and surface area of the blade. The corresponding stator blades 510 are tapered at their ends 512 to better match the opening 550 created between the two adjacent rotor blades.

Figure 6:
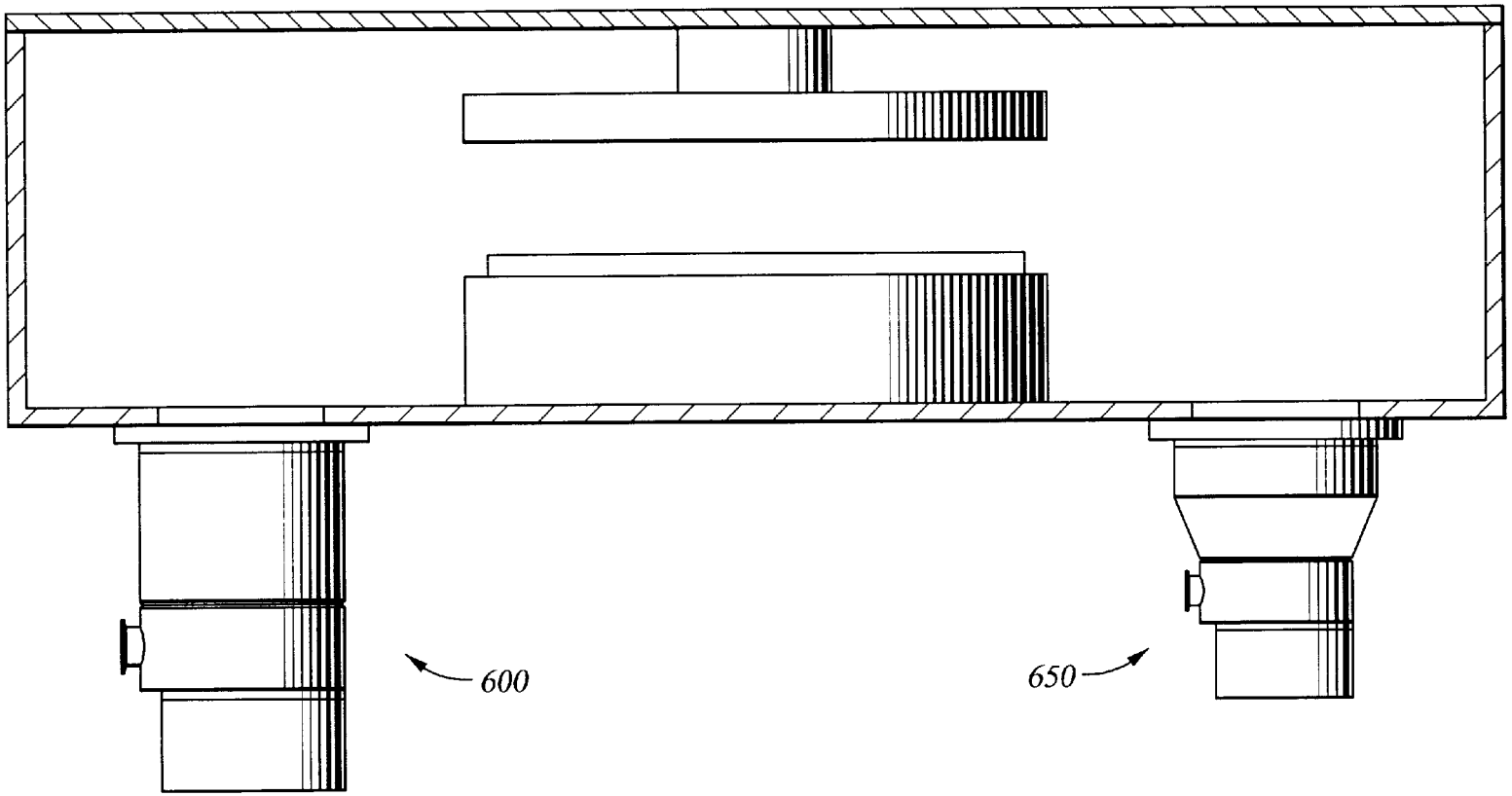
FIG. 6 is a simplified, schematic view illustrating the space saving features of the present invention as compared to a prior art pump.

FIG. 6 is a schematic view of a chamber with a pump attached at a lower surface thereto. The Figure is divided along a vertical axis to illustrate the physical size of the pump 650 of the present invention as compared to a conventional pump 625 having the same capacity. As illustrated, the conventional pump 625 has a casing 626 with a constant outer diameter in order to house blades having a uniform length. In contrast, the pump 650 includes a casing 655 widened only at the intake end 656 of the pump. Thereafter, the pump housing is narrower since the blades are not as long in that area of the pump. The unused space can be utilized by plumbing, cables or other clean room equipment.

The increase in the surface area of the blades at the intake end of the pump increases the pump capacity significantly. For example, modifying a pump rated at 2000 l/sec by enlarging only the first two or three stages as depicted in FIG. 3, will bring the capacity of the pump to almost 4000 l/sec, with no additional increase in size or weight other than the enlarged housing in the area around the longer blades of the pump. The benefits of the present invention are equally realizable in various vacuum processing chambers and vacuum processing systems that utilize turbo-molecular pumps.

While the foregoing is directed to the preferred embodiment of the present invention, other and further embodiments of the invention may be devised without departing from the basic scope thereof, and the scope thereof is determined by the claims which follow.

What is claimed is:

1. A vacuum processing system, comprising:

(a) a vacuum processing chamber; and (b) a turbo-molecular pump disposed on the vacuum processing chamber, including:

i) a casing having an inlet port and an outlet port;

ii) a stator having a plurality of rows of stator blades extending radially inwardly;

(iii) a motor disposed coaxially with a rotor; and (iv) the rotor having a plurality of rows of rotor blades extending radially outwards from an outer surface of the rotor, the rows of rotor blades disposed in an alternating arrangement with the rows of stator blades, wherein the blades of at least one row of rotor blades and the blades of at least one row of stator blades adjacent the inlet port are about 50% longer than the other rows of rotor and stator blades and an outer diameter of the pump is enlarged in an area of the longer rotor and stator blades.

2. The vacuum processing system of claim 1, wherein the vacuum processing chamber is a chemical vapor deposition chamber.

3. The vacuum processing system of claim 1, wherein the vacuum processing chamber is an etch chamber.

4. The vacuum processing system of claim 1, wherein the vacuum processing chamber is an ion implanter.

5. The vacuum processing system of claim 1, wherein the at least one row of rotor blades and the adjacent row of stator blades has about 100% more surface area than the other rotor and stator blades.

6. The vacuum processing system of claim 5, wherein the blades of the at least one row of rotor blades are widened at a connection point to the rotor.

7. A turbo-molecular pump for use with a vacuum chamber, comprising:

(a) a casing having an inlet port and an outlet port;

(b) a rotor having a plurality of rows of rotor blades disposed thereon;

(c) a stator having a plurality of rows of stator blades extending radially ad inwardly from an inner surface of the casing in an alternating arrangement with the rows of rotor blades, wherein at least one of the rows of rotor blades and one of the rows of stator blades adjacent the inlet port include blades that are longer than the other rows of rotor and stator blades and the other rows of rotor and stator blades are increasingly shorter in the direction of the outlet port and whereby the casing has a larger outer diameter in an area of the at least one row of rotor blades and the at least one row of stator blades.

8. The turbo-molecular pump of claim 7, wherein the other rows of rotor and stator blades,are-increasingly shorter in the direction of the outlet port.

9. A vacuum processing system, comprising:

(a) a vacuum processing chamber; and (b) a turbo-molecular pump disposed on the vacuum processing chamber, including;

(i) a casing having an inlet port and an outlet port;

(ii) a stator having a plurality of rows of stator blades extending radially inwardly;

(iii) a motor disposed coaxially with a rotor; and (iv) the rotor having a plurality of rows of rotor blades extending radially outwards from an outer surface of the rotor, the rows of rotor blades disposed in an alternating arrangement with the rows of stator blades, wherein the blades of at least one row of rotor blades and the blades of at least one row of stator blades adjacent the inlet port are about 50% longer than the other rows of rotor and stator blades and have about 100% more surface area than the other rows of rotor and stator blades, and wherein the blades of the at least one row of rotor blades are widened at a connection point to the rotor.

10. A vacuum processing system, comprising:

(a) a vacuum processing chamber; and (b) a turbo-molecular pump disposed on the vacuum processing chamber, including:

i) a casing having an inlet port and an outlet port;

ii) a stator having a plurality of rows of stator blades extending radially inwardly;

(iii) a motor disposed coaxially with a rotor; and (iv) the rotor having a plurality of rows of rotor blades extending radially outwards from an outer surface of the rotor, the rows of rotor blades disposed in an alternating arrangement with the rows of stator blades, wherein the blades of at least one row of rotor blades and the blades of at least one row of stator blades adjacent the inlet port are longer than the other rows of rotor and stator blades and an outer diameter of the pump is enlarged in an area of the longer rotor and stator blades.

11. The turbo molecular pump of claim 10, wherein as the pump operates, gas moves through the pump in an axial fashion between the inlet port and an outlet port.

* * * * *

UNITED STATES PATENT AND TRADEMARK OFFICE

CERTIFICATE OF CORRECTION

PATENT NO. : 6,503,050 B2 
DATED : January 7, 2003
INVENTOR(S) : Reimer et al.

It is certified that error appears in the above-identified patent and that said Letters Patent is hereby corrected as shown below:

Column 6,
Line 44, please change "radially ad inwardly" to -- radially inwardly --.

Signed and Sealed this

Second Day of September, 2003

JAMES E. ROGAN
*Director of the United States Patent and Trademark Office*